US009740116B2

(12) United States Patent
Eguchi et al.

(10) Patent No.: US 9,740,116 B2
(45) Date of Patent: Aug. 22, 2017

(54) PHOTOCONDUCTOR, AND IMAGE FORMING METHOD AND IMAGE FORMING APPARATUS USING THE PHOTOCONDUCTOR

(71) Applicants: Nobutaka Eguchi, Kanagawa (JP); Akihiro Sugino, Shizuoka (JP); Hidetoshi Kami, Shizuoka (JP); Keisuke Shimoyama, Shizuoka (JP); Kazuhiro Egawa, Shizuoka (JP)

(72) Inventors: Nobutaka Eguchi, Kanagawa (JP); Akihiro Sugino, Shizuoka (JP); Hidetoshi Kami, Shizuoka (JP); Keisuke Shimoyama, Shizuoka (JP); Kazuhiro Egawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/055,024

(22) Filed: Feb. 26, 2016

(65) Prior Publication Data

US 2016/0274475 A1 Sep. 22, 2016

(30) Foreign Application Priority Data

Mar. 18, 2015 (JP) ..... 2015-054217

(51) Int. Cl.

| | |
|---|---|
| ***G03G 5/00*** | (2006.01) |
| ***G03G 5/05*** | (2006.01) |
| ***G03G 5/14*** | (2006.01) |
| *G03G 15/05* | (2006.01) |
| *G03G 15/04* | (2006.01) |
| *G03G 15/08* | (2006.01) |

(Continued)

(52) U.S. Cl.

CPC ..... *G03G 5/0507* (2013.01); *G03G 5/144* (2013.01); *G03G 15/04* (2013.01); *G03G 15/05* (2013.01); *G03G 15/08* (2013.01); *G03G 15/16* (2013.01); *G03G 15/20* (2013.01)

(58) Field of Classification Search

CPC ..... G03G 5/144
USPC ..... 430/63, 65
See application file for complete search history.

(56) References Cited

U.S. PATENT DOCUMENTS

| | | | | |
|---|---|---|---|---|
| 2010/0316423 | A1 | 12/2010 | Kami et al. | |
| 2015/0227063 | A1 | 8/2015 | Kami et al. | |
| 2016/0154329 | A1* | 6/2016 | Kawaguchi | G03G 5/04 399/111 |

FOREIGN PATENT DOCUMENTS

| | | |
|---|---|---|
| JP | 2003-098705 | 4/2003 |
| JP | 2005-031433 | 2/2005 |

(Continued)

*Primary Examiner* — Mark A Chapman
(74) *Attorney, Agent, or Firm* — Oblon, McClelland, Maier & Neustadt, L.L.P.

(57) ABSTRACT

A photoconductor includes an electroconductive substrate; an intermediate layer overlying the electroconductive substrate; and a photosensitive layer overlying the intermediate layer. The intermediate layer includes a metal oxide particle and a binder resin, and satisfies the following relations (1) and (2):

$$Smr = Scut/Sk \quad (1)$$

$$0.4 \leq Smr \leq 0.6 \quad (2)$$

where Smr represents an areal ratio of concave parts; Sk represents a reference area; and a Scut represents a cross-sectional area obtained by cutting a three-dimensional curved surface obtained from the reference area with an average height surface, the average height surface being a surface constituted of averaged height of all measured height data.

9 Claims, 2 Drawing Sheets

(51) Int. Cl.
*G03G 15/16* (2006.01)
*G03G 15/20* (2006.01)

(56) References Cited

FOREIGN PATENT DOCUMENTS

| | | |
|---|---|---|
| JP | 2006-053577 | 2/2006 |
| JP | 2011-002480 | 1/2011 |
| JP | 2012-063720 | 3/2012 |
| JP | 2015-166847 | 9/2015 |

* cited by examiner

PHOTOCONDUCTOR, AND IMAGE FORMING METHOD AND IMAGE FORMING APPARATUS USING THE PHOTOCONDUCTOR

CROSS-REFERENCE TO RELATED APPLICATIONS

This patent application is based on and claims priority pursuant to 35 U.S.C. §119 to Japanese Patent Application No. 2015-054217 filed on Mar. 18, 2015 in the Japan Patent Office, the entire disclosure of which is hereby incorporated by reference herein.

BACKGROUND

Technical Field

The present invention relates to a photoconductor, and an image forming method and image forming apparatus using the photoconductor.

Description of the Related Art

In general, image forming apparatuses such as printers, photocopiers, facsimile machines which employ electrophotography form images through a series of processes of charging, irradiating, developing, transferring, and cleaning. The devices to conduct such image forming include at least a charger, an image irradiator, a developing device (reverse developing device), a transfer device, a cleaner, and a photoconductor.

In order to improve background fouling, it is effective that an undercoat layer or an intermediate layer is formed on an electroconductive substrate of the photoconductor and a photosensitive layer is formed through these layers. Such a method is used as a typical art. Various methods such as modifications of material constitutions and surface profiles are disclosed to improve the background fouling of the photoconductor including an undercoat layer or an intermediate layer on the electroconductive substrate.

As a disclosure on the material constitutions, a photoconductor including an undercoat layer and an intermediate layer including a specific metal oxide such as titanium oxide is known.

Meanwhile, modifying the surface profile is known as a method of improving background fouling.

However, these conventional arts do not realize an intermediate layer producing higher quality images and having higher durability.

SUMMARY

A photoconductor includes an electroconductive substrate; an intermediate layer overlying the electroconductive substrate; and a photosensitive layer overlying the intermediate layer. The intermediate layer includes a metal oxide particle and a binder resin, and satisfies the following relations (1) and (2):

$$Smr = Scut/Sk \quad (1)$$

$$0.4 \leq Smr \leq 0.6 \quad (2)$$

wherein Smr represents an areal ratio of concave parts; Sk represents a reference area; and a Scut represents a cross-sectional area obtained by cutting a three-dimensional curved surface obtained from the reference area with an average height surface, the average height surface being a surface constituted of averaged height of all measured height data.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
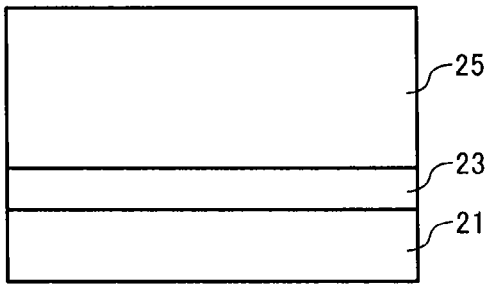
FIG. 1 is a cross-sectional view of a constitutional embodiment of the photoconductor of the present invention.

Accordingly, one object of the present invention is to provide a photoconductor producing images without background fouling and having good durability.

Another object of the present invention is to provide an electrophotographic image forming method using the photoconductor.

A further object of the present invention is to provide an electrophotographic image forming apparatus using the photoconductor.

The present invention provides a photoconductor producing images without background fouling and having good durability.

More particularly, the present invention relates to a photoconductor, including an electroconductive substrate; an intermediate layer overlying the electroconductive substrate; and a photosensitive layer overlying the intermediate layer. The intermediate layer includes a metal oxide particle and a binder resin, and satisfies the following relations (1) and (2):

$$Smr = Scut/Sk \quad (1)$$

$$0.4 \leq Smr \leq 0.6 \quad (2)$$

wherein Smr represents an areal ratio of concave parts; Sk represents a reference area; and a Scut represents a cross-sectional area obtained by cutting a three-dimensional curved surface obtained from the reference area with an average height surface, which is a surface constituted of averaged height of all measured height data.

Charge leakage from the electroconductive substrate and deterioration of chargeability cause the background fouling. In order to improve these, it is advantageous to form a suitable surface profile on the intermediate layer.

An individual dot forming the background fouling has a diameter about 50 μm in many cases, and the size becomes larger as the background fouling becomes worse. The intermediate layer typically has a large thickness to suppress the charge leakage. Therefore, it is thought the convexities and concavities are advantageously flattened to prevent background fouling, above all, sharp points of the convexities and concavities forming dots.

The thickness of the intermediate layer influences on chargeability of the photoconductor. When the chargeability of a photoconductor lowers, a difference between the charge potential and the developing bias narrows to cause foggy images. Its cause is not clear, but flattening the intermediate layer causes lowering of bulk resistance.

Even if the surface profile of the intermediate layer is simply flattened or roughened, the background fouling is not improved. Various surface profiles need to be formed using correlation between the convexities and concavities.

Suitable convexities and concavities on the intermediate layer influence the surface profile to suppress the background fouling. The surface profile needs a precise analysis, and an analysis using a laser microscope is effectively used.

An individual surface profile is formed on the intermediate layer according to conditions of film formation and a formulation of coating materials. Among various film forming methods, spray coating can be said an advantageous method of controlling the form of a film. The surface profile is most preferable when having a semi-gloss appearance.

The convexities and concavities on the intermediate layer can be controlled by metal oxide particles such as titanium oxide particles included therein.

The metal oxide particles preferably have an average primary particle diameter of from 0.18 to 0.22 μm, which is advantageous for the above "0.4≤Smr≤0.6" and production as well.

The average primary particle diameter of the metal oxide particles is measured by directly observing fine particles thereof dispersed in a reagent or a coating film with a scanning electron microscope or a confocal microscope. An image analysis software represented by image J published by US NIH is preferably used to calculate the average particle diameter.

The metal oxide particles having an average primary particle diameter of from 0.18 to 0.22 μm preferably include two metal oxide particles $T_1$ and $T_2$ having average primary particle diameters different from each other. Further, the average primary particle diameter $D_2$ of the metal oxide particles $T_2$ is preferably 0.05 μm<$D_2$<0.10 μm, which is advantageous to form the surface profile of the intermediate layer in the present invention.

At present, titanium oxide as the inexpensive metal oxide do not always satisfy the size specified in the present invention. Therefore, plural titanium oxides are preferably mixed to use. When titanium oxides having different particle sizes, spaces formed among large titanium oxides are filled with small titanium oxides, and concealment of the titanium oxides in a coating liquid improves. This is thought to suppress the background fouling. In addition, the titanium oxides having different particle sizes are advantageously used to precisely control the shape of the intermediate layer.

The average primary particle diameter $D_1$ of the metal oxide particles $T_1$ inevitably satisfies that the metal oxide particles included in the intermediate layer have an average primary particle diameter of from 0.18 to 0.22 μm and that the average primary particle diameter $D_2$ of the metal oxide particles $T_2$ is 0.05 μm<$D_2$<0.10 μm.

The intermediate layer preferably has a thickness of from 4 to 7 μm to easily form the surface profile to suppress background fouling and dry in a short time when forming the intermediate layer with a coating liquid including two titanium oxides having particle sizes different from each other and a binder resin in a solvent to save production cost. Further, the intermediate layer having thickness of from 4 to 7 μm suppresses background fouling and residual potential, improves chargeability of a photoconductor, and has less restrictions when used in an image forming apparatus.

The photoconductor preferably includes cyclohexanone in an amount of from 10 to 100 ppm.

The intermediate layer can be formed with a coating liquid including metal oxide particles and a binder resin in a solvent. The metal oxide particles preferably include two metals oxides having particle sizes different from each other. The intermediate layer having a specific surface profile of the present invention is formed by repeatedly coating a coating liquid while properly dried. Cyclohexanone is preferably mixed in the coating liquid to form the surface profile. A boiling point and a viscosity thereof are thought to work. In addition, the intermediate layer including cyclohexanone in an amount of from 100 to 1,000 pp improves durability of the photoconductor with the surface profiles of the photoconductor and the photosensitive layer.

The image forming method and the image forming apparatus using the specific photoconductor in which "0.4≤Smr≤0.6" of the present invention have lives not less than 5 times longer than those in each of which the surface profile of the intermediate layer is not controlled. This is achieved by effects of the surface profiles of the photoconductor and a photosensitive layer, and effective in practical use.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Herein after, constitutions of the photoconductor of the present invention are explained.

FIG. 1 is a cross-sectional view of a constitutional embodiment of the photoconductor of the present invention, in which at least an intermediate layer including metal oxide particles of the present invention (23) and a photosensitive layer (25) are layered on an electroconductive substrate (21). The photosensitive layer has a single-layered structure in which charge generation and charge transport functions are not separated.

Figure 2:
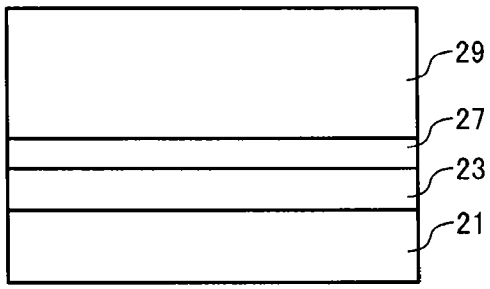
FIG. 2 is a cross-sectional view of another constitutional embodiment of the photoconductor of the present invention.

FIG. 2 is a cross-sectional view of another constitutional embodiment of the photoconductor of the present invention, in which at least an intermediate layer including metal oxide particles (23), a charge generation layer (27) and a charge transport layer (29) are layered on an electroconductive substrate (21). The photosensitive layer has a multilayered structure in which charge generation and charge transport functions are separated.

Figure 3:
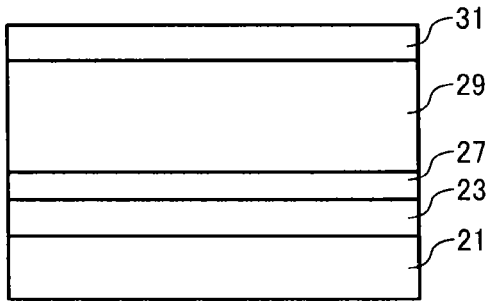
FIG. 3 is a cross-sectional view of a further constitutional embodiment of the photoconductor of the present invention.

FIG. 3 is a cross-sectional view of a further constitutional embodiment of the photoconductor of the present invention, in which a protection layer (31) is further formed on the charge transport layer (29) in FIG. 2.

As the electroconductive substrate (21), an electroconductive substrate having a volume resistance of not greater than $10\times10^{10}$ Ω·cm such as plastic or paper having a film-like form or cylindrical form covered with a metal such as aluminum, nickel, chrome, nichrome, copper, gold, silver, and platinum, or a metal oxide such as tin oxide and indium oxide by depositing or sputtering, or a board formed of aluminum, an aluminum alloy, nickel, and a stainless metal can be used and a tube which is manufactured from the board mentioned above by a crafting technique such as extruding and extracting and surface-treatment such as cutting, super finishing, and grinding can be used.

The aluminum alloys are formed by the method disclosed in JIS3003, 5000, 6000, etc. and the non-cut aluminum tube is formed by a conventional method such as EI, ED, DI and II methods. In addition, a surface cut process and grind with a diamond turning tool, etc. or a surface treatment such as anodizing is performed on the aluminum tube.

Further, endless belts of a metal such as nickel and stainless steel, which have been disclosed in Japanese published unexamined application No. JP-S52-36016-A can also be used as the electroconductive substrate (21).

As mentioned above, the non-cut aluminum tube is occasionally used to reduce cost of the electroconductive substrate. As the non-cut aluminum tube, DI tube formed by subjecting an aluminum disc to deep drawing to have the shape of a cup and the outer surface to ironing, II tube formed by subjecting an aluminum disc to impact processing to have the shape of a cup and the outer surface to ironing, EI tube formed by subjecting the outer surface of an aluminum drawn tube to ironing and ED tube formed by subjecting an aluminum disc to extrusion and cold drawing disclosed in Japanese published unexamined application No. JP-H03-192265-A are known.

These non-cut aluminum tubes tend to produce abnormal images such as moiré. However, the photoconductor of the present invention produces high-quality images without producing abnormal images such as moiré and has good durability even formed of the non-cut aluminum tube.

In addition, an electroconductive substrate formed by coating a liquid in which electroconductive powder is dispersed in a suitable binder resin on a substrate made from plastic can also be used as the electroconductive substrate (21). Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resin used simultaneously include, but are not limited to, thermoplastic resins, thermosetting resins or photocurable resins such as polystyrene resins, copolymers of styrene and acrylonitrile, copolymers of styrene and butadiene, copolymers of styrene and maleic anhydrate, polyesters resins, polyvinyl chloride resins, copolymers of a vinyl chloride and a vinyl acetate, polyvinyl acetate resins, polyvinylidene chloride resins, polyarylate resins, phenoxy resins, polycarbonate reins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenolic resins, and alkyd resins.

Such an electroconductive layer can be formed by dispersing the electroconductive powder and the binder resins mentioned above in a suitable solvent, for example, tetrahydrofuran, dichloromethane, 2-butanone and toluene, and applying the resultant to an electroconductive substrate.

Further, an electroconductive substrate formed by providing a heat contraction tube as an electroconductive layer on a suitable cylindrical substrate can also be used as the electroconductive substrate (21) in the present invention. The heat contraction tube is formed of materials such as polyvinyl chloride, polypropylene, polyester, polystyrene, polyvinylidene chloride, polyethylene, chloride rubber, and polytetrafluoroethylene fluororesins, which includes the electroconductive powder mentioned above.

The intermediate layer (23) mainly includes metal oxide particles and a resin. Considering that a photosensitive layer is applied to the intermediate layer in a form of solvent, the resin is preferably hardly soluble in a known organic solvent.

The metal oxide particles are preferably titanium oxide particles. Hereinafter, titanium oxide particles are used as the metal oxide particles.

Specific examples of such resins include, but are not limited to, water-soluble resins such as polyvinyl alcohol, casein and sodium polyacrylate, alcohol-soluble resins such as copolymerized nylon, and methoxymethylated nylon, curing resins forming three-dimensional structure such as polyurethane, melamine resins, alkyd-melamine resins and epoxy resins.

A weight ratio of the titanium oxide particles to the resin is preferably from 3/1 to 8/1. When less than 3/1, carrier transportability of the intermediate layer lowers to cause residual potential or lowers photoresponsivity. When greater than 8/1, spaces in the intermediate layer increase and air bubbles are formed therein when a photosensitive layer is formed thereon.

The titanium oxide can be prepared by a sulfuric acid method or a chlorine method, and the chlorine method is preferably used to prepare titanium oxide having high purity.

The chlorine method includes chlorinating titanium slug with chlorine to form titanium tetrachloride; separating, condensing, refining and oxidizing the titanium tetrachloride to form crude titanium oxide; crushing, classifying, applying a surface treatment to when necessary, filtering, washing, drying and pulverizing the crude titanium oxide to prepare titanium oxide. The particle diameter of the titanium oxide can be controlled by controlling the primary particle diameter thereof.

In the present invention, titanium oxides having different average primary particle diameters are used to improve concealment of an electroconductive substrate, which suppresses moiré and decreases pin holes causing abnormal images.

Therefore, it is essential two titanium oxides have a constant particle diameter ratio in a specific range (preferably from 0.18 to 0.22 μm as mentioned above). When the average primary particle diameter is too small, the metal oxide increases in surface activation and the electrostatic stability of the resultant photoconductor is impaired. When too large, concealment of the electroconductive substrate lowers, resulting in deterioration of suppressing moiré and decreases pin holes causing abnormal images.

The purity of the titanium oxide can be controlled by purity of materials or surface treatment, and particularly the chlorine method can obtain metal oxide having high purity. The titanium oxide preferably has a purity not less than 99.0%. Impurities thereof are mostly hygroscopic and ionic materials such as Na2O and K2O. When the purity is less than 99.0%, properties of the resultant photoconductor largely change due to the environment (particularly to the humidity) and repeated use. Further, the impurities tend to cause defective images such as black spots. The purity of the titanium oxide can be determined by a measurement method specified in JIS K5116.

The titanium oxide preferably has a rutilated rate of from 10 to 60%.

Typically, the metal oxide has two crystal forms, i.e., anatase and rutile, and they affect specific gravity, refractive index, and hardness of the metal oxide. The crystal form depends on sintering conditions when preparing metal oxide. Mild conditions form an anatase crystal and a rutile crystal is formed as sintering temperature increases. Therefore, the sintering temperature is controlled to control the rutilated rate. The reason why the rutilated rate of from 10 to 60% is preferable is not clarified, but which improves background fouling. The metal oxide more preferably has a rutilated rate of from 30 to 60%.

The rutilated rate can be measured by an intensity of an interference line caused by each crystal form in a powder X-ray diffraction.

As mentioned above, the metal oxide particles having an average primary particle diameter of from 0.18 to 0.22 μm preferably include two metal oxide particles $T_1$ and $T_2$ having average primary particle diameters different from each other. Further, the average primary particle diameter $D_2$ of the metal oxide particles $T_2$ is preferably 0.05 μm<$D_2$<0.10 μm.

In addition, $0.2 \leq [T_2/(T_1+T_2)] \leq 0.8$ is preferable.

When less than 0.2, abnormal images such as black spots and background fouling are less suppressed. When greater than 0.8, light scatterability lowers in the intermediate layer, resulting in moiré.

The intermediate layer (23) is formed by coating a coating liquid including a suitable solvent, titanium oxide and a binder resin.

The intermediate layer (23) preferably has a thickness of from 1.0 to 10 μm, and more preferably from 4.0 to 7.0 μm.

The charge generation layer (27) includes at least a charge generation material and a binder resin when necessary.

Specific examples of the binder resin include, but are not limited to, polyamide, polyurethane, epoxy resins, polyketone, polycarbonate, polyarylate, silicone resins, acrylic resins, polyvinyl butyral resins, polyvinyl formal resins, polyvinyl ketone, polystyrene, poly-N-vinylcarb azole, polyacrylamide, polyvinylbenzal, polyester, phenoxy resins, vinylchloride-vinylacetate copolymers, polyvinyl acetate, polyphenyleneoxide, polyvinylpyridine, cellulose resins, casein, polyvinylalcohol and polyvinylpyrrolidone.

The charge generation layer preferably includes the binder resin in an amount of from 0 to 500 parts by weight, and more preferably from 10 to 300 parts by weight per 100 parts by weight of the charge generation material.

Specific examples of the charge generation material include, but are not limited to, phthalocyanine pigments such as metal phthalocyanine and metal-free phthalocyanine; azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments; and azo pigments such as monoazo pigments, bisazo pigments, asymmetric disazo pigments, trisazo pigments and tetraazo pigments.

The charge generation layer (27) is formed by dispersing at least a charge generation material and a binder resin when necessary in a solvent using a ball mill, an attritor, a sand mill or an ultrasonic to prepare a coating liquid, and applying and drying the coating liquid on the intermediate layer (23).

Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroin.

Specific examples of methods of coating a coating liquid include, but are not limited to, dip coating methods, spray coating methods, bead coating methods, nozzle coating methods, spinner coating methods and ring coating methods.

The charge generation layer (27) typically has a thickness of from 0.01 to 5 μm, and preferably from 0.1 to 2 μm.

The charge transport layer (29) includes a charge transport material as a main component, and is formed by dispersing a charge transport material and a binder resin in a solvent such as tetrahydrofuran, dioxane, dioxolane, anisole, toluene, monochlorbenzene, dichlorethane, methylene chloride and cyclohexanone, and applying and drying the solution or the dispersion on the charge generation layer (27).

The charge transport material includes a positive hole transport material and an electron transport materials.

Specific examples of the electron transport materials include known electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, 3, 5-dimethyl-3', 5'-ditertiarybutyl-4, 4'-diphenoquinone and benzoquinone derivatives. These electron transport materials can be used alone or in combination.

Specific examples of the positive hole transport materials include, but are not limited to, electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, thiazole derivatives, triazole derivatives, phenazine derivatives, acridine derivatives, benzofuran derivatives, benzimidazole derivatives and thiophene derivatives. These positive hole transport materials can be used alone or in combination.

Specific examples of the binder resin for use in the charge transport layer include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the polycarbonate copolymers disclosed in Japanese published unexamined applications Nos. JP-H05-158250-A and JP-H06-51544-A.

In addition, a charge transport polymer material having functions of a binder resin and a charge transport material can be used as the binder resin. The charge transport polymer materials have the following constitutions:

(a) polymers having a carbazole ring include poly-N-vinyl carbazole, and compounds disclosed in Japanese published unexamined applications Nos. JP-S50-82056-A, JP-S54-9632-A, JP-S54-11737-A and JP-H04-183719-A;

(b) polymers having a hydrazone skeleton include compounds disclosed in Japanese published unexamined applications Nos. JP-S57-78402-A and JP-H03-50555-A;

(c) polysilylene compounds include compounds disclosed in Japanese published unexamined applications Nos. JP-S63-285552-A, JP-H05-19497-A and JP-H05-70595-A; and (d) polymers having a triaryl amine skeleton include N, N-bis(4-methylphenyl)-4-aminopolystyrene, and compounds disclosed in Japanese published unexamined applications Nos. JP-H01-13061-A, JP-H01-19049-A, JP-H01-

1728-A, JP-H01-105260-A, JP-H02-167335-A, JP-H05-66598-A and JP-H05-40350-A.

The charge transport layer preferably includes a binder resin of from 0 to 200 parts by weight per 100 parts by weight of the charge transport material.

The charge transport layer may include a plasticizer, a leveling agent and an antioxidant when necessary.

Specific examples of the plasticizer include halogenated paraffin, dimethyl naphthalene, dibutylphthalate, dioctylphthalate, tricresyl phosphate, polymer and copolymers of polyester, etc. The charge transport layer preferably includes the plasticizer in an amount of from 0 to 30 parts by weight per 100 parts by weight of the binder resin.

Specific examples of the leveling agent include silicone oils such as dimethylsilicone oil and methylphenyl silicone oil; and a polymer or an oligomer having an alkyl group on the side chain. The charge transport layer preferably includes the leveling agent in an amount of from 0 to 1 part by weight per 100 parts by weight of the binder resin.

The charge transport layer may include an antioxidant to improve environmental resistance, i.e., against oxidizing gas such as ozone and NOx. The antioxidant may be added to any layers including an organic material, and preferably added to a layer including a charge transport material.

Specific examples of the antioxidant include, but are not limited to, hindered phenol compounds, sulfuric compounds, phosphate compounds, hindered amine compounds, pyridine derivatives, a piperidine derivatives and morpholine derivatives. The charge transport layer preferably includes the antioxidant in an amount of from 0 to 5 part by weight per 100 parts by weight of the binder resin.

The charge transport layer preferably has a thickness of from 5 to 50 μm, more preferably from 20 to 40 μm, and furthermore preferably from 25 to 35 μm.

The photosensitive layer (25) of a single-layered photoconductor (25) includes a charge generation material, a dispersant, a charge transport material and a binder resin. The above-mentioned charge generation materials and the charge transport materials can be used.

The single-layered photosensitive layer is formed by dissolving or dispersing a charge generation material, a charge transport material, a dispersant and a binder resin in a solvent such as tetrahydrofuran, cyclohexanone, dioxane, dichloroethane and butanone with a ball mill, an attritor or a sand mill to prepare a solution or a dispersion, and applying and drying the solution or the dispersion. The solution or the dispersion are applied by a dip coating method, a spray coating method, a roll coating method or a blade coating method.

As the binder resin, the binder resin used in the charge transport material can be used, and may be combined with the resin used in the charge generation material.

In addition, a single-layered photosensitive layer including a eutectic complex formed of a pyrylium dye and bisphenol A polycarbonate, and a charge transport material can be prepared by the above-mentioned method.

Further, the single-layered photosensitive layer may include a plasticizer, a leveling agent, an antioxidant, etc.

The single-layered photosensitive layer preferably has a thickness of form 5 to 50 μm.

The protection layer (31) is formed to improve durability of the photoconductor.

Suitable materials for use in the protection layer include ABS resins, ACS resins, olefin-vinyl monomer copolymers, chlorinated polyethers, aryl resins, phenolic resins, polyacetal, polyamides, polyester resins, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, polyester, etc.

The protection layer (31) may include an inorganic material such as fluororesins, e.g., polytetrafluoroethylene, silicone resins, metal oxide, aluminum oxide, tin oxide, zinc oxide, magnesium oxide, silica and their surface-treated materials, and further s charge transport material.

The protection layer (31) is formed by a conventional coating method. The protection layer (31) preferably has a thickness of from 0.1 to 10 μm.

In addition, a protection layer formed by a vacuum thin film forming method using known materials such as a-C and a-SiC can be used.

In the present invention, another intermediate layer (unillustrated) can be formed between the photosensitive layer (25) and the protection layer (31). The intermediate layer includes a resin as a main component. Specific examples thereof include polyamide, alcohol-soluble nylon resins, hydrosoluble butyral resins, polyvinylbutyral and polyvinylalcohol. The intermediate layer can be formed by the conventional coating methods, and preferably has a thickness of from 0.05 to 2 μm.

The photoconductor of the present invention is explained.

The areal ratio Smr of concave parts of the intermediate layer of the photoconductor of the present invention is specified by the following formula (1):

$$Smr = Scut/Sk \quad (1)$$

wherein Sk represents a reference area; and a Scut represents a cross-sectional area obtained by cutting a three-dimensional curved surface obtained from the reference area with an average height surface, which is a surface constituted of averaged height of all measured height data.

The areal ratio Smr of concave parts satisfies the following relation:

$$0.4 \leq Smr \leq 0.6 \quad (2)$$

Scut in the present invention is a value obtained by expanding a load length Rmr (50%) of a roughness curve defined in JIS B 0601-2001 in the surface direction.

The convexities on the surface of the intermediate layer can be measured by a marketed laser microscope. For example, the following laser microscopes can be used.

Ultra-depth profile measuring microscope VK-8550 and VK-8700 from Keyence Corp.

Surface profile measuring system Surface Explorer SX-520DR from Ryoka Systems Inc.

Scanning confocal laser microscope OLS3000 from Olympus Corp.

Real color confocal microscope OPTELICS C130 from Lasertec Corp.

Even when the individual concavity has a Scut value not greater than 1 $\mu m^2$, the laser microscopes and the optical microscope can be used. However, in order to more precisely observed, the following electron microscopes are preferably used.

Ultra-depth profile measuring microscope VK-9500, VK-9500GII and VK-9700 from Keyence Corp.

Violet laser microscope such as Nanosearch Microscope SFT-3500 from Shimadzu Corp.

Real surface view microscope VE-7800, VE-8800 and VE-9800 from Keyence Corp.

Carry scope JCM-5100 from JEOL Ltd.

The plural concavities formed on the intermediate layer all may have the same shape, size and depth or different shapes and sizes.

The intermediate layer may directly be analyzed alone or after a photosensitive layer is peeled and the exposed intermediate layer is washed when necessary. The imaging forming method is named an electrophotographic method and the imaging forming apparatus is named an electrophotographic apparatus.

The imaging method of the present invention includes a charging process charging a photoconductor, an irradiating process writing an electrostatic latent image on the surface of the charged photoconductor, a developing process developing the electrostatic latent image with a toner to from a toner image, a transferring process transferring the toner image onto a transfer material, a fixing process fixing the toner image thereon, and other processes when necessary.

The imaging forming method of the present invention can be executed by the image forming apparatus of this invention. The imaging forming apparatus of the present invention includes a photoconductor bearing a latent image, a charger charging the surface of the photoconductor, an irradiator writing an electrostatic latent image on the surface of the charged photoconductor, an image developer developing the electrostatic latent image with a toner to from a toner image, a transferor transferring the toner image onto a transfer material, a fixer process fixing the toner image thereon, and other means when necessary.

Figure 4:
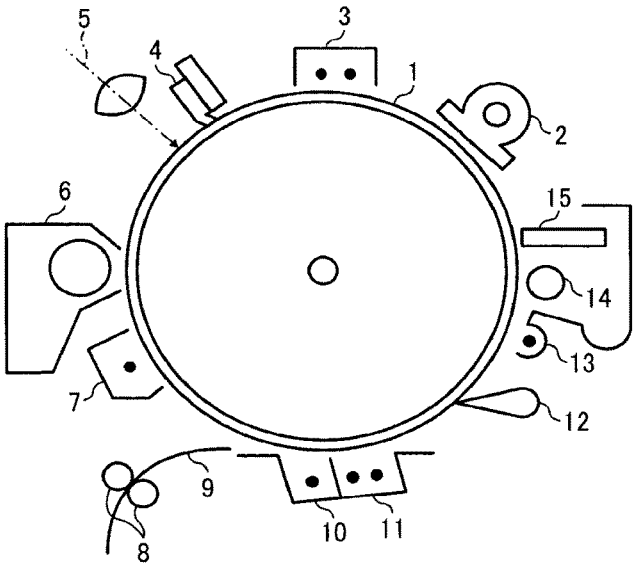
FIG. 4 is a schematic view for explaining the electrophotographic image forming method and the electrophotographic image forming apparatus of the present invention.

FIG. 4 is a schematic view for explaining the electrophotographic method and apparatus of the present invention, and a modified embodiment as mentioned below belongs to the present invention. In FIG. 4, a photoconductor 1 is drum-shaped, and may be sheet-shaped or endless-belt shaped. Any known chargers such as a corotron, a scorotron, a solid state charger and a charging roller can be used for a charger 3, a pre-transfer charger 7, a transfer charger 10, a separation charger 11 and a pre-cleaning charger 13.

The above-mentioned chargers can be used as transfer means, and typically a combination of the transfer charger and the separation charger is effectively used.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL) and the like.

In addition, in order to obtain light having a desired wave length range, filters such as sharp-cut filters, band pass filters, near-infrared cutting filters, dichroic filters, interference filters, color temperature converting filters and the like can be used.

The above-mentioned light sources can be used for not only the processes mentioned above and illustrated in FIG. 10, but also other processes, such as a transfer process, a discharging process, a cleaning process, a pre-exposure process, which include light irradiation to the photoconductor. In FIG. 4, Numeral 4 is an eraser, 8 is a registration roller and a 12 is a separation claw.

When a toner image formed on the photoconductor 1 by a developing unit 6 is transferred onto a transfer sheet 9, all of the toner image are not transferred thereon, and residual toner particles remain on the surface of the photoconductor 1. The residual toner is removed from the photoconductor by a fur blush 14 and a blade 15. The residual toner remaining on the photoconductor 1 can be removed by only a cleaning brush. Suitable cleaning blushes include known cleaning blushes such as fur blushes and mag-fur blushes.

When the photoconductor which is previously charged positively is exposed to imagewise light, an electrostatic latent image having a positive or negative charge is formed on the photoconductor. When the latent image having a positive charge is developed with a toner having a negative charge, a positive image can be obtained. In contrast, when the latent image having a positive charge is developed with a toner having a positive charge, a negative image can be obtained. As the developing method, known developing methods can be used. In addition, as the discharging methods, known discharging methods can be also used.

The above-mentioned image forming devices may be fixedly set to the image forming apparatus (such as copiers, facsimiles and printers), but can be set to the image forming apparatus as a unit, i.e., a process cartridge. The process cartridge includes a photoconductor, and at least one of a charger, an irradiator, an image developer, a transferor, a cleaner and a discharger, which is detachable from the image forming apparatus.

Figure 5:
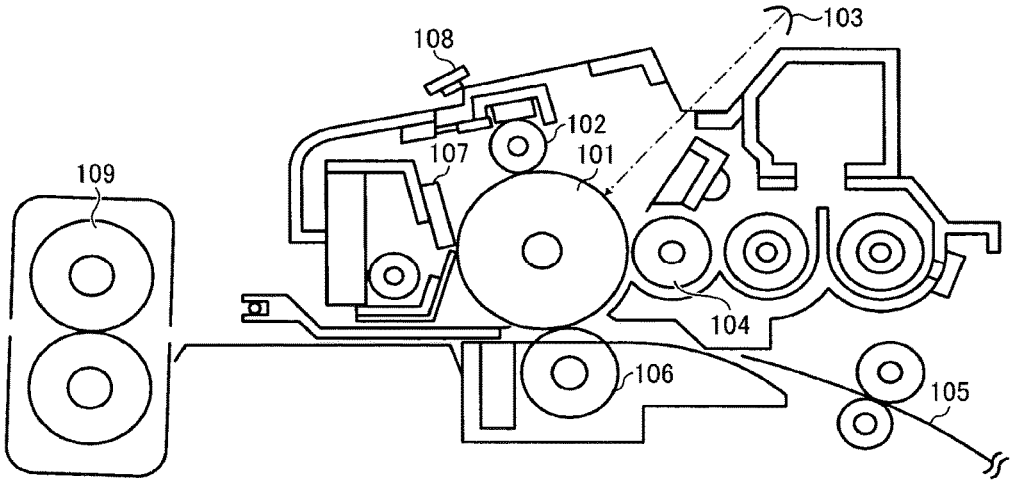
FIG. 5 is a schematic view illustrating an embodiment of electrophotographic image forming apparatus using the process cartridge of the present invention.

Various process cartridges can be used, and an example of the process cartridge used in imagio MF200 from Ricoh Company, Ltd. is illustrated in FIG. 5. FIG. 5 is a schematic view illustrating an electrophotographic image forming apparatus using the electrophotographic process cartridge of the present invention.

A charger 102 charges a photoconductor 101, an irradiator 103 irradiates the photoconductor 101 to form an electrostatic latent image on the photoconductor 101. An image developer 104 develops the latent image with a toner, a transferor 106 transfers the toner image onto a transfer material 105, and which passes a fixer 109 to be a hardcopy.

A cleaning blade 107 cleans the surface of the photoconductor 101, and a discharge lamp 108 discharges the photoconductor 101. The receiving paper 105, the image transfer device 106, the discharge lamp 108 and the fixer 109 are not included in the process cartridge.

As irradiating processes, an imagewise light exposure and a discharge exposure are illustrated, the photoconductor can be irradiated with other known irradiating processes such as a pre-transfer exposure and an exposure before the imagewise light exposure.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

The below-mentioned intermediate layer coating liquid was applied on an aluminum drum having a thickness of 3 mm, a length of 970 mm and a diameter of 80 mm, followed by drying to form an intermediate layer with a thickness of 5 μm. Next, the below-mentioned charge generation layer coating liquid was applied on the intermediate layer, followed by drying to form a charge generation layer with a thickness of 1 μm. Further, the below-mentioned charge transport layer coating liquid was applied on the charge generation layer, followed by drying to form a charge transport layer with a thickness of 30 μm.

[Intermediate Layer]

A mixture having the following compositions was dispersed by a ball mill for 72 hrs to prepare an intermediate layer coating liquid.

[Compositions of Intermediate Layer Coating Liquid]

| | |
|---|---|
| Metal oxide $T_1$ (Purity: 99.7%; Rutilated Rate: 99.1%; and Average Primary Particle Diameter: 0.25 μm) | 120 |
| Metal oxide $T_2$ (Purity: 99.8%; Anatase Type; and Average Primary Particle Diameter: 0.25 μm) | 30 |
| Alkyd Resin (BECKOLITE M6401-50 including a solid content of 50% from DIC Corp.) | 84 |
| Melamine resin solution (SUPER BECKAMIN G-821-60 including a solid content of 60% from DIC Corp.) | 47 |
| Methyl Ethyl Ketone | 1,330 |
| Cyclohexanone | 570 |

The intermediate layer coating liquid was sprayed on the aluminum drum having a length of 970 mm and a diameter of 80 mm, followed by drying at 150° C. for 35 min to form an intermediate layer having a thickness of 5 μm.

[Charge Generation Layer]

A mill base having the following compositions was dispersed by a ball mill for 72 hrs.

[Mill Base Compositions]

| | |
|---|---|
| Asymmetric Disazo Pigment having the following formula (X) | 10 |

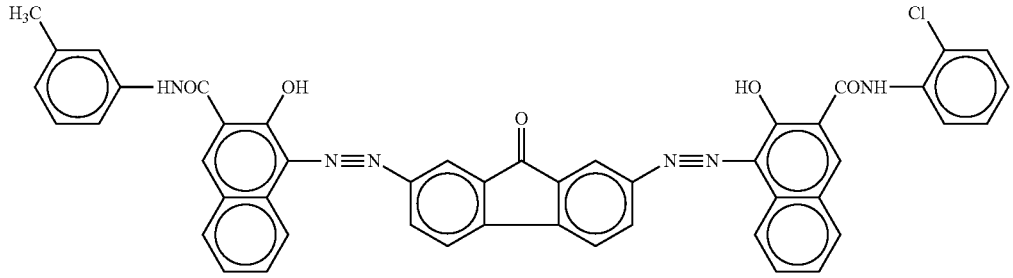

(X)

| | |
|---|---|
| Metal-Free Phthalocyanine Pigment | 5 |
| Polyvinylbutyral (Butvar-B90) | 3 |
| Cyclohexanone | 150 |

A mill base having the above composition was dispersed by a ball mill for 72 hrs.

After dispersion, 250 parts by weight of cyclohexanone and 1,200 parts by weight of 2-butanone were added to the dispersion, followed by dispersing for 3 hrs to prepare the charge generation coating liquid.

The charge generation coating liquid was coated on the intermediate layer to form the charge generation layer having a thickness of 1 μm thereon.

[Charge Transport Layer]

The following compositions were dissolved to prepare a charge transport coating liquid.

[Compositions of Charge Transport Layer Coating Liquid]

| | |
|---|---|
| A compound having the following formula (Y) | 7 |

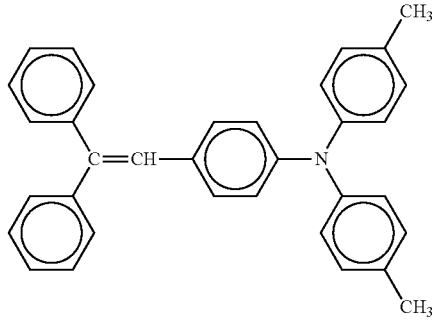

(Y)

| | |
|---|---|
| Polycarbonate Resin (TS-2040 from Teijin Chemicals Ltd.) | 11 |
| Silicone Oil (KF-50 from Shin-Etsu Chemical Co., Ltd.) | 0.002 |
| Antioxidant (Sumilizer TPS from Sumitomo Chemical Co., Ltd.) | 0.08 |
| Compound having the following formula (Z) | 0.5 |

-continued

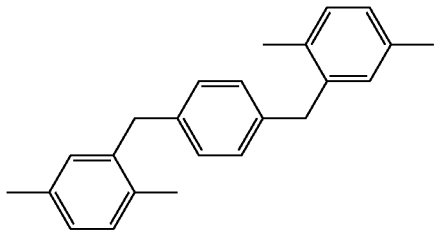

(Z)

| | |
|---|---|
| Tetrahydrofuran | 90 |
| Cyclohexanone | 160 |

The charge transport layer coating liquid was coated on the charge generation layer, and dried at 155° C. for 60 min to form a charge transport layer having an average thickness of 30 μm thereon. Thus, a photoconductor was prepared.

Example 2

The procedure for preparation of the photoconductor in Example 1 was repeated except for changing the amounts of the solvents in the intermediate layer as follows.

| | |
|---|---|
| Methyl Ethyl Ketone | 1,620 |
| Cyclohexanone | 280 |

Comparative Example 1

The procedure for preparation of the photoconductor in Example 1 was repeated except for changing the amounts of the solvents in the intermediate layer as follows.

| | |
|---|---|
| Methyl Ethyl Ketone | 1,720 |
| Cyclohexanone | 180 |

Example 3

The procedure for preparation of the photoconductor in Example 1 was repeated except for changing the metal oxide ($T_2$) as follows.

| | |
|---|---|
| Metal oxide $T_2$ | 30 |

(Purity: 99.99%; Rutilated Rate: 90.1%; and Average Primary Particle Diameter 0.13 μm)

Example 4

The procedure for preparation of the photoconductor in Example 1 was repeated except for changing the metal oxide ($T_2$) as follows.

| | |
|---|---|
| Metal oxide $T_2$ | 30 |

(Purity: 99.99%; Rutilated Rate: 46.7%; and Average Primary Particle Diameter 0.07 μm)

Example 5

The procedure for preparation of the photoconductor in Example 1 was repeated except for changing the metal oxide ($T_1$) and the metal oxide ($T_2$) as follows.

| | |
|---|---|
| Metal oxide $T_1$ | 85 |

(Purity: 99.1%; Rutilated Rate: 99%; and Average Primary Particle Diameter 0.25 μm)

| | |
|---|---|
| Metal oxide $T_2$ | 65 |

(Purity: 99.99%; Rutilated Rate: 46.7%; and Average Primary Particle Diameter 0.07 μm)

Example 6

The procedure for preparation of the photoconductor in Example 1 was repeated except for changing the metal oxide ($T_1$) and the metal oxide ($T_2$) as follows.

| | |
|---|---|
| Metal oxide $T_1$ | 130 |

(Purity: 99.1%; Rutilated Rate: 99.1%; and Average Primary Particle Diameter 0.25 μm)

| | |
|---|---|
| Metal oxide $T_2$ | 20 |

(Purity: 99.8%; Anatase Rate: 80%; and Average Primary Particle Diameter 0.036 μm)

Example 7

The procedure for preparation of the photoconductor in Example 4 was repeated except for controlling spray coating such that the intermediate layer had a thickness of 3.5 μm.

Example 8

The procedure for preparation of the photoconductor in Example 4 was repeated except for controlling spray coating such that the intermediate layer had a thickness of 4 μm.

Example 9

The procedure for preparation of the photoconductor in Example 4 was repeated except for controlling spray coating such that the intermediate layer had a thickness of 7 μm.

Example 10

The procedure for preparation of the photoconductor in Example 4 was repeated except for controlling spray coating such that the intermediate layer had a thickness of 10 μm.

Comparative Example 2

The procedure for preparation of the photoconductor in Example 4 was repeated except for changing the amounts of the solvents in the intermediate layer as follows.

| | |
|---|---|
| Methyl Ethyl Ketone | 570 |
| Cyclohexanone | 1,330 |

Comparative Example 3

The procedure for preparation of the photoconductor in Example 4 was repeated except for changing the amounts of the solvents in the intermediate layer as follows.

| | |
|---|---|
| Methyl Ethyl Ketone | 1,900 |
| Cyclohexanone | 0 |

Comparative Example 4

The procedure for preparation of the photoconductor in Example 4 was repeated except for changing the amounts of the solvents in the intermediate layer as follows and the application method from the spraying method to a dipping method.

| | |
|---|---|
| Methyl Ethyl Ketone | 500 |
| Cyclohexanone | 0 |

<Test>

The photoconductors of Examples 1 to 10 and Comparative Examples 1 to 4 and image forming apparatuses using them were evaluated with respect to the following properties (1) and (2). The contents of the cyclohexanone in the photoconductors were measured under the following conditions (3). The evaluation results are shown in Table 1.

(1) The surface profile measurement of intermediate layer of photoconductor

As for concavities and convexities on the intermediate layer of the photoconductor, random one point of the photosensitive layer in the circumferential direction at every 194 mm from the end of the drum was observed with a confocal microscope from Lasertec Corp. Data analysis was executed to determine Smr of the convexities on the surface of the intermediate layer. The measurement parameter was as follows.

Reference area (Sk)=100 $\mu m^2$

Cutoff value ($\lambda s$)=0.25 μm

Cutoff value ($\lambda c$)=0.08 μm

After the durability test mentioned later, the photosensitive layer was peeled with a cutter at random one point of the photosensitive layer in the circumferential direction at every 194 mm from the end of the drum in a rectangular shape of 20 mm×20 mm to measure a profile curve of the exposed intermediate layer. The charge generation layer adhering to the intermediate layer was wiped out with methanol. The profile curve of the intermediate layer measured alone right after coated was not particularly different from that after the photosensitive layer was coated and peeled.

(2) Background Fouling Test

Each of the photoconductors was installed in imagio MP W7140 from Ricoh Company, Ltd., and a text image pattern having an image density of 6% was continuously produced in an environment of 25° C. and 55% RH. The photoconductor was controlled to have a charge potential of −800 V with a grid bias of the charger when starting the test. The image was printed on the whole surface of My Paper A1 having a size of 841 mm×200 m. Genuine toner and developer were used. Background fouling was classified to 5 grades, and the image was produced until a level that the background fouling is not accepted in the market. Background fouling durability was evaluated by a mileage of the photoconductor during which the test was performable.

(3) Content of Cyclohexanone in Photoconductor

A piece of the photoconductor together with the aluminum substrate in an appropriate size was cut out to be a sample. The layer film was weighed by deducting a weight of the aluminum substrate from a weight of the sample. Cyclohexanone included in the photoconductor was measured by GCMS method using QP-2010 from Shimadzu Corp. (Column: Ultra ALLOY-5 L: 30 m I. D: 0.25 mm Film: 0.25 μm).

TABLE 1

| | $T_1$ | | $T_2$ | | | | Eval. | |
|---|---|---|---|---|---|---|---|---|
| | Average primary particle diameter (μm) | Rutilated rate (%) | Average primary particle diameter (μm) | Rutilated rate (%) | Intermediate layer thickness (μm) | Intermediate layer Smr | Photo-conductor mileage (km) | Content of cyclo-hexanone (ppm) |
| Example 1 | 0.25 | 99.1 | 0.40 | — | 5.0 | 0.50 | 40 | 12 |
| Example 2 | 0.25 | 99.1 | 0.40 | — | 5.0 | 0.40 | 40 | 12 |
| Comparative Example 1 | 0.25 | 99.1 | 0.40 | — | 5.0 | 0.65 | 10 | 12 |
| Example 3 | 0.25 | 99.1 | 0.13 | 90.1 | 5.0 | 0.45 | 50 | 12 |
| Example 4 | 0.25 | 99.1 | 0.07 | 46.7 | 5.0 | 0.42 | 60 | 12 |
| Example 5 | 0.25 | 99.1 | 0.07 | 46.7 | 5.0 | 0.40 | 40 | 12 |
| Example 6 | 0.25 | 99.1 | 0.036 | 46.7 | 5.0 | 0.35 | 30 | 12 |
| Example 7 | 0.25 | 99.1 | 0.07 | 46.7 | 3.5 | 0.50 | 20 | 10 |
| Example 8 | 0.25 | 99.1 | 0.07 | 46.7 | 4.0 | 0.45 | 50 | 11 |
| Example 9 | 0.25 | 99.1 | 0.07 | 46.7 | 7.0 | 0.40 | 40 | 14 |
| Example 10 | 0.25 | 99.1 | 0.07 | 46.7 | 10.0 | 0.25 | 20 | 20 |
| Comparative Example 2 | 0.25 | 99.1 | 0.07 | 46.7 | 5.0 | 0.15 | 10 | 500 |
| Comparative Example 3 | 0.25 | 99.1 | 0.07 | 46.7 | 5.0 | 0.75 | 10 | 0 |
| Comparative Example 4 | 0.25 | 99.1 | 0.07 | 46.7 | 5.0 | 0.10 | 10 | 0 |

As is evident from Table 1, each of the photoconductors including an intermediate layer having a surface profile in which 0.4≤Smr≤0.6 has no background fouling and good durability, i.e., mileage is not less than 20 km. Particularly, the intermediate layer including two titanium oxides having high purity and average primary particle diameters different from each other makes the photoconductor have good properties producing no abnormal images such as black spots. Further, the titanium oxide having a rutilated rate of from 30 to 60% further prevents production of abnormal images such as black spots. In addition, the image forming apparatus using the photoconductor of the present invention has good properties as well.

Each of Comparative Examples 1 to 4 which does not satisfy the requirement of including an intermediate layer having a surface profile in which 0.4≤Smr≤0.6 has background fouling and poor durability (mileage is 10 km).

Namely, the photoconductor of the present invention stably produces high-quality images even when repeatedly used for long periods, preventing production of abnormal images such as uneven image density and background fouling. The photoconductor can meet speeding up, downsizing, colorization, higher image quality and easy maintenance strongly desired for image forming apparatuses such as copiers, laser printers and plain paper facsimile and image forming method.

Having now fully described the invention, it will be apparent to one of ordinary skill in the art that many changes and modifications can be made thereto without departing from the spirit and scope of the invention as set forth therein.

What is claimed is:

1. A photoconductor, comprising:

an electroconductive substrate;

an intermediate layer overlying the electroconductive substrate; and a photosensitive layer overlying the intermediate layer, wherein the intermediate layer comprises a metal oxide particle and a binder resin, and satisfies the following relations (1) and (2):

$$Smr = Scut/Sk \quad (1)$$

$$0.4 \leq Smr \leq 0.6 \quad (2)$$

wherein Smr represents an areal ratio of concave parts; Sk represents a reference area; and a Scut represents a cross-sectional area obtained by cutting a three-dimensional curved surface obtained from the reference area with an average height surface, the average height surface being a surface constituted of averaged height of all measured height data.

2. The photoconductor of claim 1, wherein the metal oxide particle comprises a titanium oxide particle.

3. The photoconductor of claim 1, wherein the metal oxide particle has an average primary particle diameter of from 0.18 to 0.22 μm.

4. The photoconductor of claim 3, wherein the metal oxide particle comprises a mixture of a metal oxide particle $T_1$ and a metal oxide particle $T_2$ each having an average primary particle diameter different from each other, and wherein the metal oxide particle $T_2$ has an average primary particle diameter ($D_2$) larger than 0.05 μm and smaller than 0.10 μm.

5. The photoconductor of claim 1, wherein the metal oxide particle comprises a titanium oxide particle having a rutilated rate of from 30% to 60%.

6. The photoconductor of claim 1, wherein the intermediate layer has a thickness of from 4 to 7 μm.

7. The photoconductor of claim 1, further comprising cyclohexanone in an amount of from 10 to 100 ppm.

8. An image forming method, comprising:

charging a surface of the photoconductor according to claim 1;

irradiating the surface of the photoconductor with light to form an electrostatic latent image on the surface;

developing the electrostatic latent image with a toner to form a toner image (on the surface of the photoconductor);

transferring the toner image from the surface of the photoconductor onto a transfer material; and fixing the toner image on the transfer material.

9. An image forming apparatus, comprising:

the photoconductor according to claim 1 to carry a latent image;

a charger to charge a surface of the photoconductor;

an irradiator to irradiate the surface of the photoconductor with light to form an electrostatic latent image on the surface;

an image developer to develop the electrostatic latent image with a toner to form a toner image (on the surface of the photoconductor);

a transferer to transfer the toner image from the surface of the photoconductor onto a transfer material; and a fixer to fix the toner image on the transfer material.

* * * * *